US005591392A

United States Patent [19]

Usami et al.

[11] Patent Number: 5,591,392

[45] Date of Patent: Jan. 7, 1997

[54] STEEL PLATE HAVING GOOD CORROSION RESISTANCE TO CONDENSED WATER

[75] Inventors: Akira Usami; Takashi Inoue; Kouji Tanabe, all of Futtsu, Japan

[73] Assignee: Nippon Steel Corporation, Tokyo, Japan

[21] Appl. No.: 539,495

[22] Filed: Oct. 6, 1995

Related U.S. Application Data

[63] Continuation of Ser. No. 156,345, Nov. 22, 1993, abandoned.

[30] Foreign Application Priority Data

Nov. 24, 1992 [JP] Japan ..... 4-313797
Dec. 24, 1992 [JP] Japan ..... 4-344863

[51] Int. Cl.[6] ..... C22C 38/24; C22C 38/08; C22C 38/12

[52] U.S. Cl. ..... 420/41; 420/60; 420/93; 420/92; 420/104

[58] Field of Search ..... 420/41, 60, 34, 420/104, 93, 42, 92

[56] References Cited

U.S. PATENT DOCUMENTS 4,331,474 5/1982 Espy ..... 420/60
4,465,525 8/1984 Yoshimura et al. ..... 420/41

FOREIGN PATENT DOCUMENTS 60-17055 1/1983 Japan ..... 420/60
59-9149 1/1984 Japan ..... 420/60
1-165752 6/1989 Japan .
1-306585 12/1989 Japan .

OTHER PUBLICATIONS

Key To Steels, 10 Edition 1974, Germany.

*Primary Examiner*—Deborah Yee
*Attorney, Agent, or Firm*—Kenyon & Kenyon

[57] ABSTRACT

The invention relates to a steel plate which exhibits a good resistance to a corrosive atmosphere, containing weakly acidic condensed water comprising $SO_2$, $Cl^-$ ion, and $CO_2$ such as the exhaust gas from a boiler which burns LNG.

The steel plate having a good corrosion resistance to condensed water characterized in comprising a low C content, a low Mn content and a medium amount of Cr content, and further 0.01% or less of S in an unavoidable impurity, or further comprising at least one element of Si, Al, Cu, Ni, Mo, Nb, V, Ti, Ca, and B. More, the steel plate having a good corrosion resistance to condensed water comprising carbonic acid gas and chloride ion characterized in comprising a low C content, a low Mn content, P, Cu and Ni, and further 0.01% or less of S in an unavoidable impurity, or further comprising at least one element of Si, Al, Mo, Nb, V, Ti, Ca and B.

4 Claims, No Drawings

STEEL PLATE HAVING GOOD CORROSION RESISTANCE TO CONDENSED WATER

This application is a continuation, of application Ser. No. 08/156,345 filed Nov. 22, 1993, now abandoned.

BACKGROUND OF THE INVENTION

1. Field of the Invention

The invention relates to a steel plate having good resistance to a corrosive atmosphere, containing weakly acidic (pH 3.5 to 5.5) condensed water comprising SO2, $Cl^-$ ion and $CO_2$, in a power station which burns LNG, etc.

2. Description of the Related Art

An exhaust gas from a boiler which burns LNG contains $SO_2$, $Cl^-$ ions, $CO_2$ and a water vapour component, with the result that condensed water is brought into existence between the bailer and the funnel due to a drop in the exhaust gas temperature. The condensed water is a weakly acidic (pH 3.5 to 5.5) and contains dissolved $SO_2$, $Cl^-$ ions and $CO_2$, and is highly corrosive. Previously, a stainless steel and carbon steel have been used, as a steel material, in an atmosphere producing this corrosive condensed water.

For instance, in the case of stainless steels, Unexamined Japanese Patent Publication (Kokai) No. 1-165752, discloses a method in which a ferritic stainless steel comprising 14 to 21% of Cr, Ni, Cu, Mo, etc., and having a corrosion resistance in halogenide compounds can be used. In case of carbon steels, Unexamined Japanese Patent Publication (Kokai) No. 1-306585 discloses a method in which the corrosion can be prevented by adding a corrosion inhibitor into the solution in contact with the steel.

SUMMARY OF THE INVENTION

The Invention, which has been constituted for solving the above problems, has the object of providing a steel material comprising the compositions of low C and high Cr alloy systems, being lower in cost compared with stainless steels, and having a corrosion resistance at least three times better than carbon steels. Namely, the gist of the invention will be as described below.

(1) A steel plate, having a good resistance to corrosive condensed water, consisting essentially of, by weight %, C: 0.05% or less; Mn: 0.2 to 1.6%; S: 0.01% or less; Cr: 7.0 to 13.0%; V: 0.005 to 0.1%; and the Ca: 0.005 to 0.01%; remainder being Fe and unavoidable impurities.

(2) The steel plate having a good resistance to corrosive condensed water according to item (1), further comprising at least one element selected from the group consisting of, by weight %, Si: 0.005 to 0.5%; Al: 0.005 to 0.07%; Cu: 0.05 to 1.0%; Ni: 0.05 to 2.0%; Mo: 0.05 to 1.0%; Nb: 0.005 to 0.1%; Ti: 0.005 to 0.1%; Ca: B: 0.003 to 0.005%.

(3) A steel plate, having a good resistance to corrosive condensed water, consisting essentially of, by weight %, C: 0.05% or less; Mn: 0.2 to 1.6%; S: 0.01% or less; P: 0.01 to 0.3%; Cu: 0.05 to 2.5%; Ni: 0.05 to 5.0%; V: 0/005 to 0.1%; and Ca: 0.005 to 0.01%; the remainder being Fe and unavailable impurities.

(4) A steel plate having a good resistance to corrosive condensed water according to item (3), further comprising at least one element selected from the group consisting of, by weight %, Mo: 0.05 to 1.0%; Si: 0.005 to 0.5%; Al: 0.005 to 0.07%; Nb: 0.0005 to 0.1%; Ti: 0.005 to 0.1%; B: 0.003 to 0.005%.

DESCRIPTION OF THE PREFERRED EMBODIMENTS

At the outset, a steel plate having a good resistance to corrosive condensed water according to the invention exhibits a good resistance to a corrosive atmosphere containing weakly acidic (pH 3.5 to 5.5) condensed water comprising $SO_2$, $Cl^-$ ions and $CO_2$. More, the corrosive atmosphere containing condensed water gives rise to dew condensation, e.g. between a boiler which burns LNG and a funnel, due to a drop in the exhaust gas temperature while dissolving a corrosive material in an exhaust gas, and still progressing corrosion.

The invention will be described in detail below.

In the first invention, as mentioned above, it is indispensable for the composition to comprise low C, low S, low Mn and 7.0 to 13% of a medium amount of Cr. Eventually, the steel plate itself can improve its corrosion resistance by the multiplied effect of the following effects. The first is the effect of decreasing a cathodic active site by restraining the amount of precipitation of $Fe_3C$ as the result of lowering the C content. The second is the effect of restraining the formation of MnS, which weakens the resistance of a film comprising hydrated oxides of Fe and Cr to $Cl^-$ ion, as a result of lowering the S and the contents. The third is the effect of forming a protective film on the steel plate surface by intermediary Cr content. Due to the above, the steel plate having a good corrosion resistance to condensed water can be obtained without resorting to anticorrosion measure.

In the second invention, as mentioned above, it is indispensable for the composition to comprise low C, low S, low Mn, 0.01 to 0.3% of a medium amount of P, 0.05 to 2.5% of a medium amount of Cu and 0.05 to 5.0% of a medium amount of Ni. Eventually, the steel plate itself can improve its corrosion resistance by the multiplied effect of the following effects. The first is the effect of decreasing a cathodic active site by restraining the amount of precipitation of $Fe_3C$ as the result of lowering the C content. The second is the effect of restraining the formation of MnS, which weakens the resistance of a film mainly comprising hydrated iron oxides to $Cl^-$ ions, as the result of lowering the S and Mn contents. The third is the effect of improving the fineness of a rust layer, i.e. the critically formed nucleus from a colloidal deposited rust becomes small, as the result of adding Cu. The fourth is the effect of remarkably improving the above effect of adding Cu content, due to the smallness and spheroidization of a critically formed nucleus from a colloidal deposited rust, as the result of an addition of P and Cu. The fifth is the effect of improving the corrosion resistance of the whole surface, due to formation of an Ni rich layer on the surface, as the result of adding Ni. In consequence of the above, the steel plate having a good corrosion resistance to weakly acidic condensed water comprising carbonic acid gas and chloride ion can be obtained without resorting to anticorrosion measures.

Further, the steel plate itself can still improve the its corrosion resistance by the multiplied effect of adding Mo content with the following. The first is the effect of improving a pitting corrosion resistance by improving a self restoration function of the film, even if the film mainly comprising hydrated iron oxides was once damaged by $Cl^-$ ions, in which the dissolved Mo can enhance a cross-linking reaction mainly comprising hydrated iron oxides in the film by virtue of adding Mo, with the result that the above film can be easily restored and reformed. The second is the effect of restraining dissolution of the film comprising hydrated iron oxide, by restraining a drop of pH on the steel surface, as the result of adding Mo.

The reason for restricting the amounts of the alloyed elements will be described below.

The C content is preferably lower for corrosion resistance, but it is contained in steel during the melting process. When C exceeds 0.05%, cathodic sites increase due to an increase in $Fe_3C$ precipitation, with the result that the corrosive resistance remarkably deteriorates, and thus C is kept at 0.05% or less.

Mn is added to fix S, existing as an impurity in steel, as MnS. Less than 0.2% of Mn will not achieve a sufficient effect, and more than 1.6% of Mn deteriorates workability, and thus Mn is kept at 0.2 to 1.6%.

Cr forms a film, having good corrosion resistance, comprising hydrated oxides of Fe and Cr, on the steel surface, wit the result that the corrosion resistance of the steel can be improved. The effect is exhibited at 7.0% or more of Cr. On the other hand, more than 13.0% of Cr deteriorates workability, and thus the content is kept at 7.0 to 13.0%.

S exists as an impurity in steel. When the amount of S increases, a sulphide can be formed, and MnS, which weakens the resistance of a film comprising hydrated oxides of Fe and Cr to $Cl^-$ ion, increases, with the result that the corrosion resistance remarkably deteriorates, and thus S is kept at 0.01% or less.

When P is not less than 0.01%, a mixed addition with Cu enables the critical diameter of corrosion production, which deposits and precipitates on the steel, to be smaller, and further a film from the corrosion product to be fined due to spheroidization of its configuration, with the result that the corrosion resistance can be improved. More than 0.3% of P deteriorates ductility, and thus P is kept at 0.01 to 0.3%.

Al is added as a deoxidization element in steel making. Less than 0.005% of Al is not sufficient in the oxidization effect, and deteriorates ductility. On the other hand, more than 0.07% of Al deteriorates corrosion resistance, and thus its content is kept at 0.005 to 0.07%.

Cu is an element which can improve a corrosion resistance. The effect is exhibited by 0.05% or more of Cu, but an excess of Cu leads to fine precipitation of Cu in steel, with the result that a microelectric cell is formed on the steel surface, and thus the corrosion of the steel is enhanced. More than 1.0% of Cu makes marked progress in the enhancement of the corrosion, and thus, in the first invention, the Cu content is kept at 0.05 to 1.0%.

In the second invention, a mixed addition of Cu and P becomes to fine the film formed from a corrosion production based on the above mechanism, and the effect is exhibited at 0.05% or more of Cu. More than 2.5% of Cu saturates the effect, and increases the cost, and thus Cu is kept at 0.05 to 2.5% in the second invention.

When Ni is not less than 0.05%, Ni is an effective element to improve corrosion resistance. More than 2.0% of Ni saturates the effect, and therewith leads to an increase in cost, and thus Ni is kept at 0.05 to 2.0% in the first invention.

In the second invention, more than 5.0% of Ni saturates the effect, and leads to an increase in cost, and thus Ni is kept at 0.05 to 5.0%.

Mo is an effective element to improve corrosion resistance, when Mo is not less than 0.05%, due to the mechanism in which Mo improves the self restoration function of the film comprising hydrated iron oxides. More than 1.0% of Mo saturates the effect, and thus Mo is kept at 0.05 to 1.0%.

Further, Si is added, if required, as an oxidizating element in steel making. Less than 0.005% of Si is not sufficient in its oxidization effect, with the result that ductility deteriorates. On the other hand, more than 0.5% of Si deteriorates the corrosion resistance, and thus Si is kept at 0.005 to 0.5%.

When each of Ti, Nb and V is not less than 0.005%, these elements are effective for ensuring workability, as the result of fixing C and N, and thereby restraining a rise in strength caused by C and N. The effect is sufficient at 0.1% of each element, and thus each element is kept at 0.005 to 0.1%.

Moreover, not less than 0.0005% of Ca restrains the activity of hydrogen on the steel surface, and thereby Ca is an effective element for corrosion resistance. The effect is sufficient at 0.01% of Ca, and thus Ca is kept at 0.0005 to 0.01%.

Further, when B is 0.003% or more, B gives rise to a mechanism for restraining a dissolution rate for a cathode reduction of the protecting film on the steel surface, in addition to the effect of compensating for a strength drop due to low C and low Mn contents, with the result that a protecting function of the protecting film on the steel surface can be improved.

The effect is sufficient at 0,005% of B, and thus B is kept at 0.003 to 0.005%.

The invention will be described in detail based on examples of the preferred embodiment and comparative examples below.

EXAMPLE

The specimens for corrosion tests were cut, at the ½t position, from a 5 mm thick plates, No. 1 to No. 23 and No. 24 to 67 having chemical compositions as shown in Table. 1 and Tables. 2 to 3. The specimens were subjected to a corrosion test.

The corrosion test was conducted as a repeated test, under dry and wet conditions with predetermined cycles, in which a mixed gas shown in Table 5 is ventilated through the water solution comprising the components shown in Table 4, with the result that the corrosive atmosphere containing condensed water of exhaust gas from boiler which burns LNG can be duplicated. Corrosion resistance was evaluated by the average decrease in thickness converted into an amount of corrosion decrease.

TABLE 1

(Chemical composition: wt. %)

| Sample No. | | C | Cr | S | Mn | Si | Al | Cu | Ni | Mo | Nb | V | Ti | B | Ca | Average thickness decrease |
|---|---|---|---|---|---|---|---|---|---|---|---|---|---|---|---|---|
| Present invention | 1 | 0.05 | 7.90 | 0.008 | 0.2 | 0.21 | 0.005 | — | — | — | — | — | — | — | — | 0.13 cm |
| | 2 | 0.01 | 7.00 | 0.004 | 0.3 | 0.24 | 0.027 | — | — | 0.05 | — | — | — | — | — | 0.18 cm |
| | 3 | 0.02 | 13.00 | 0.006 | 0.3 | 0.37 | 0.031 | — | — | — | 0.10 | — | — | 0.003 | — | 0.03 cm |
| | 4 | 0.01 | 9.80 | 0.010 | 0.4 | 0.15 | 0.037 | — | — | — | — | — | — | — | — | 0.08 cm |
| | 5 | 0.03 | 8.30 | 0.005 | 0.2 | 0.45 | 0.023 | — | 2.00 | — | — | — | 0.005 | — | — | 0.15 cm |

TABLE 1-continued

| Sample No. | | C | Cr | S | Mn | Si | Al | Cu | Ni | Mo | Nb | V | Ti | B | Ca | (Chemical composition: wt. %) Average thickness decrease |
|---|---|---|---|---|---|---|---|---|---|---|---|---|---|---|---|---|
| | 6 | 0.01 | 7.90 | 0.008 | 1.6 | 0.43 | 0.070 | — | — | — | — | — | — | — | — | 0.13 cm |
| | 7 | 0.01 | 11.50 | 0.004 | 1.3 | — | — | — | — | — | — | — | — | — | — | 0.05 cm |
| | 8 | 0.03 | 8.70 | 0.004 | 1.2 | 0.35 | — | — | — | — | — | — | — | — | — | 0.11 cm |
| | 9 | 0.03 | 9.70 | 0.010 | 0.6 | 0.02 | 0.039 | — | — | — | — | — | — | — | — | 0.12 cm |
| | 10 | 0.01 | 9.50 | 0.010 | 0.7 | 0.45 | 0.027 | 1.00 | — | — | — | — | — | — | — | 0.15 cm |
| | 11 | 0.02 | 9.20 | 0.006 | 0.2 | 0.18 | 0.051 | — | — | 0.18 | — | 0.005 | 0.10 | — | — | 0.14 cm |
| | 12 | 0.01 | 8.40 | 0.007 | 0.5 | 0.19 | 0.025 | 0.21 | 0.05 | 1.00 | 0.01 | — | 0.02 | — | 0.0080 | 0.12 cm |
| | 13 | 0.02 | 7.60 | 0.005 | 0.7 | 0.28 | 0.025 | 0.05 | 0.15 | 0.13 | 0.01 | 0.10 | 0.05 | 0.005 | 0.0100 | 0.11 cm |
| | 14 | 0.01 | 7.90 | 0.005 | 0.3 | 0.05 | 0.002 | — | — | — | — | — | — | — | — | 0.14 cm |
| | 15 | 0.01 | 7.50 | 0.004 | 0.2 | — | 0.025 | — | — | — | 0.05 | 0.05 | — | — | — | 0.15 cm |
| | 16 | 0.02 | 7.80 | 0.005 | 0.2 | 0.30 | — | — | — | — | — | — | 0.07 | — | — | 0.16 cm |
| Comparative example | 17 | 0.13* | 0.05* | 0.02* | 1.4 | 0.23 | 0.024 | 0.20 | 0.20 | — | — | — | — | — | — | 0.56 cm |
| | 18 | 0.15* | 0.12* | 0.005 | 0.8 | 0.20 | 0.020 | — | — | — | — | — | — | — | — | 1.12 cm |
| | 19 | 0.17* | 7.90 | 0.005 | 0.3 | 0.05 | 0.002 | — | — | — | — | — | — | — | — | 0.68 cm |
| | 20 | 0.01 | 5.4* | 0.03* | 0.4 | 0.02 | 0.005 | — | — | 1.00 | — | — | — | — | — | 0.89 cm |
| | 21 | 0.01 | 7.50 | 0.02* | 0.3 | — | 0.025 | — | — | — | 0.05 | 0.05 | — | — | — | 0.86 cm |
| | 22 | 0.02 | 4.8* | 0.005 | 0.2 | 0.30 | — | — | — | — | — | — | 0.07 | — | — | 0.78 cm |
| | 23 | 0.12* | 8.20 | 0.005 | 0.5 | — | 0.029 | — | — | — | — | — | — | — | 0.0005 | 0.59 cm |

*: Condition outside range of the invention.

TABLE 2

| Sample No. | | C | S | P | Cu | Ni | Mn | Mo | Si |
|---|---|---|---|---|---|---|---|---|---|
| | | | | | | (Chemical composition: wt. %) | | | |
| Present invention | 24 | 0.02 | 0.005 | 0.030 | 0.55 | 0.95 | 0.20 | — | — |
| | 25 | 0.05 | 0.008 | 0.250 | 0.77 | 0.99 | 0.20 | 0.75 | — |
| | 26 | 0.02 | 0.005 | 0.010 | 0.10 | 1.23 | 0.50 | — | 0.050 |
| | 27 | 0.05 | 0.008 | 0.250 | 0.77 | 0.99 | 0.20 | — | — |
| | 28 | 0.02 | 0.005 | 0.010 | 0.25 | 0.66 | 0.30 | — | — |
| | 29 | 0.01 | 0.004 | 0.130 | 2.50 | 3.18 | 0.30 | — | 0.010 |
| | 30 | 0.05 | 0.008 | 0.250 | 0.77 | 0.99 | 0.20 | 0.55 | 0.010 |
| | 31 | 0.03 | 0.004 | 0.050 | 0.97 | 4.50 | 1.20 | 0.75 | 0.350 |
| | 32 | 0.03 | 0.004 | 0.050 | 0.97 | 4.75 | 1.20 | 0.81 | 0.350 |
| | 33 | 0.01 | 0.010 | 0.075 | 1.57 | 1.25 | 0.40 | — | — |
| | 34 | 0.03 | 0.005 | 0.210 | 0.83 | 2.00 | 0.20 | — | — |
| | 35 | 0.01 | 0.008 | 0.110 | 2.21 | 0.77 | 1.60 | — | — |
| | 36 | 0.05 | 0.008 | 0.250 | 0.77 | 0.99 | 0.20 | — | — |
| | 37 | 0.01 | 0.004 | 0.030 | 0.59 | 2.48 | 0.30 | 0.350 | 0.370 |
| | 38 | 0.02 | 0.005 | 0.010 | 0.25 | 0.55 | 0.20 | — | — |
| | 39 | 0.01 | 0.004 | 0.130 | 2.50 | 3.18 | 0.50 | 0.250 | — |
| | 40 | 0.05 | 0.008 | 0.250 | 0.77 | 0.99 | 0.20 | — | 0.410 |
| | 41 | 0.03 | 0.004 | 0.050 | 0.97 | 4.50 | 0.30 | — | — |
| | 42 | 0.01 | 0.004 | 0.130 | 2.50 | 3.18 | 0.30 | 0.05 | 0.240 |
| | 43 | 0.02 | 0.006 | 0.090 | 0.21 | 2.22 | 0.30 | — | 0.370 |
| | 44 | 0.01 | 0.010 | 0.075 | 1.67 | 1.25 | 0.40 | — | 0.150 |
| | 45 | 0.03 | 0.005 | 0.210 | 0.83 | 2.00 | 0.20 | — | 0.005 |
| | 46 | 0.01 | 0.008 | 0.110 | 2.21 | 0.77 | 1.60 | — | 0.430 |
| | 47 | 0.03 | 0.005 | 0.210 | 0.83 | 2.00 | 0.20 | 0.25 | — |
| | 48 | 0.01 | 0.004 | 0.030 | 0.59 | 2.48 | 0.30 | — | 0.030 |
| | 49 | 0.03 | 0.004 | 0.050 | 0.97 | 5.00 | 1.20 | 0.75 | 0.350 |
| | 50 | 0.03 | 0.010 | 0.090 | 1.97 | 3.75 | 0.57 | — | 0.020 |
| | 51 | 0.01 | 0.004 | 0.065 | 1.00 | 1.23 | 0.70 | — | 0.450 |
| | 52 | 0.02 | 0.006 | 0.085 | 0.25 | 0.55 | 0.20 | 0.18 | 0.500 |
| | 53 | 0.02 | 0.006 | 0.085 | 0.25 | 0.55 | 0.20 | 0.18 | 0.500 |
| | 54 | 0.01 | 0.007 | 0.210 | 0.21 | 0.05 | 0.50 | 1.00 | 0.190 |
| | 55 | 0.02 | 0.005 | 0.300 | 0.05 | 0.15 | 0.70 | 0.13 | 0.280 |
| | 56 | 0.01 | 0.005 | 0.050 | 0.25 | 0.10 | 1.44 | — | 0.230 |
| | 57 | 0.03 | 0.005 | 0.070 | 0.35 | 0.55 | 0.30 | — | 0.200 |
| | 58 | 0.02 | 0.005 | 0.050 | 0.57 | 0.85 | 0.30 | — | 0.050 |
| | 59 | 0.01 | 0.005 | 0.150 | 0.83 | 1.25 | 0.40 | 1.00 | 0.020 |
| | 60 | 0.01 | 0.003 | 0.100 | 1.55 | 4.25 | 0.30 | — | — |
| | 61 | 0.02 | 0.005 | 0.030 | 0.55 | 0.95 | 0.20 | 1.00 | — |
| Comparative example | 62 | 0.13* | 0.005 | 0.050 | 0.25 | 0.10 | 1.44 | — | 0.230 |
| | 63 | 0.03 | 0.08* | 0.070 | 0.35 | 0.55 | 0.80 | — | 0.200 |
| | 64 | 0.02 | 0.005 | 0.005* | 0.57 | 0.85 | 0.30 | — | 0.050 |
| | 65 | 0.01 | 0.005 | 0.150 | 0.02* | 1.25 | 0.40 | 1.00 | 0.020 |
| | 66 | 0.01 | 0.003 | 0.100 | 1.55 | 0.02* | 0.30 | — | — |
| | 67 | 0.01 | 0.003 | 0.070 | 0.56 | 0.25 | 0.15* | — | 0.025 |

*: Condition of outside range of the invention.

TABLE 3

| Sample No. | | Al | Nb | V | Ti | B | Ca | Average thickness decrease. |
|---|---|---|---|---|---|---|---|---|
| | | (Chemical composition: wt. %) | | | | | | |
| Present invention | 24 | — | — | — | — | — | — | 1.13 cm |
| | 25 | — | — | — | — | — | — | 0.09 cm |
| | 26 | — | — | — | — | — | — | 0.11 cm |
| | 27 | 0.033 | — | — | — | — | — | 0.13 cm |
| | 28 | 0.005 | — | — | — | — | — | 0.11 cm |
| | 29 | 0.025 | — | — | — | — | — | 0.11 cm |
| | 30 | 0.025 | — | — | — | — | — | 0.06 cm |
| | 31 | — | — | — | — | — | — | 0.04 cm |
| | 32 | — | — | — | — | — | — | 0.05 cm |
| | 33 | — | 0.070 | — | — | — | — | 0.13 cm |
| | 34 | — | — | 0.005 | — | — | — | 0.12 cm |
| | 35 | — | — | — | 0.005 | — | — | 0.11 cm |
| | 36 | — | — | — | — | 0.003 | — | 0.13 cm |
| | 37 | — | — | — | 0.003 | — | — | 0.12 cm |
| | 38 | — | — | — | — | — | 0.005 | 0.11 cm |
| | 39 | — | — | — | — | — | 0.001 | 0.09 cm |
| | 40 | — | — | — | — | — | 0.008 | 0.11 cm |
| | 41 | — | — | 0.005 | 0.100 | — | 0.001 | 0.05 cm |
| | 42 | 0.027 | — | — | — | — | — | 0.05 cm |
| | 43 | 0.031 | 0.100 | — | — | 0.003 | — | 0.11 cm |
| | 44 | 0.005 | — | — | — | — | — | 0.08 cm |
| | 45 | 0.023 | — | — | 0.005 | — | — | 0.13 cm |
| | 46 | — | 0.070 | — | — | — | — | 0.13 cm |
| | 47 | 0.030 | — | — | — | — | 0.030 | 0.11 cm |
| | 48 | — | — | 0.050 | — | — | 0.0005 | 0.05 cm |
| | 49 | — | — | — | — | 0.004 | — | 0.11 cm |
| | 50 | 0.039 | 0.030 | — | — | — | — | 0.12 cm |
| | 51 | 0.070 | — | — | 0.030 | 0.003 | — | 0.13 cm |
| | 52 | 0.051 | 0.005 | 0.005 | 0.100 | — | — | 0.12 cm |
| | 53 | 0.051 | 0.005 | 0.005 | 0.100 | — | 0.0050 | 0.11 cm |
| | 54 | 0.025 | 0.005 | — | 0.020 | — | 0.0080 | 0.12 cm |
| | 55 | 0.025 | 0.010 | 0.100 | 0.050 | 0.005 | 0.0100 | 0.11 cm |
| | 56 | 0.024 | — | — | — | — | — | 0.12 cm |
| | 57 | 0.020 | — | — | — | — | — | 0.11 cm |
| | 58 | 0.002 | — | — | — | — | 0.0050 | 0.14 cm |
| | 59 | 0.005 | — | — | — | — | — | 0.15 cm |
| | 60 | 0.025 | 0.050 | 0.050 | — | — | — | 0.11 cm |
| | 61 | — | — | — | — | — | — | 0.04 cm |
| Comparative example | 62 | 0.024 | — | — | — | — | — | 0.56 cm |
| | 63 | 0.020 | — | — | — | — | — | 1.12 cm |
| | 64 | 0.002 | — | — | — | — | 0.0050 | 0.68 cm |
| | 65 | 0.005 | — | — | — | — | — | 0.89 cm |
| | 66 | 0.025 | 0.050 | 0.050 | — | — | — | 0.86 cm |
| | 67 | — | — | — | 0.005 | — | — | 0.95 cm |

TABLE 4

| Water solution composition in corrosion test | | |
|---|---|---|
| pH | $Na_2SO_4$ | NaCl |
| 3.5 | 0.1 mol/L | 0.1 wt. % |

TABLE 5

| Mixed gas composition used for corrosion test | | |
|---|---|---|
| $CO_2$ | $O_2$ | $N_2$ |
| 12.0% | 2.0% | res. |

Though the maximum average decrease of thickness is 0.18 cm in samples of No. 1 to 16 and No. 24 to 61 of the invention in the above Tables 1 to 3, the most excellent one is 0.56 cm in samples of No. 17 to 23 and No. 62 to 67 of comparative examples, with the result that the steel of the invention has at least three times or more corrosion resistance than the comparative examples.

The present invention and comparative examples will be further described more concretely.

From No. 14 of the present invention and No. 19 of the comparative example, and No. 56 of the present invention and No. 62 of the comparative example, it can be seen that corrosion resistance is improved by decreasing a cathodic active site due to restraining the amount of precipitation of $Fe_3C$, as the result of lowering the C content.

From No. 15 of the present invention and No. 21 of the comparative example, and No. 57 of the present invention and No. 63 of the comparative example, it can be seen that the corrosion resistance is improved by restraining the formation of MnS, which weakens the resistance of a film mainly comprising hydrated iron oxides to $Cl^-$ ions, as the result of lowering the S and Mn contents.

From No. 16 of the present invention and No. 22 of the comparative example, it can be seen that corrosion resistance is improved by forming a protecting film on the steel surface, as the result of adding a medium amount of Cr.

From No. 58 of the present invention and No. 64 of the comparative example, and No. 59 of the present invention and No. 65 of the comparative example, it can be seen that the corrosion resistance is improved by improving a fineness of a rust layer, i.e. a critically formed nucleus from a colloidal deposited rust becomes small and converts from acicular to spheroidized configuration, as the result of adding P and Cu.

From No. 60 of the present invention and No. 66 of the comparative example, it can be seen that corrosion resistance is improved by forming an Ni rich layer on the surface due to an Ni content.

From No. 24 and No. 61 of the present invention, it can be seen that corrosion resistance is further improved by the multiplied effect or improving pitting corrosion by the mechanism of improving the resistance of a film, mainly comprising hydrated iron oxide, to $Cl^-$ ion, and the effect of restraining dissolution of an hydrated iron oxide film by restraining the pH drop, on the steel surface, as the result of adding Mo.

As is apparent from the foregoing embodiment, the present invention is capable of providing a steel plate which has improved a resistance, to a corrosive atmosphere containing weakly acidic condensed water, compared with a conventional steel.

We claim:

1. A steel plate having good corrosion resistance to condensed water consisting essentially of, by weight %, C: 0.05% or less;

Mn: 0.2 to 1.6%;

S: 0.01% or less;

Cr: 7.0 to 9.8%;

V: 0.005 to 0.1%;

Ca: 0.0005 to 0.01%;

and the remainder being Fe and unavoidable impurities.

2. The steel plate having good corrosion resistance to condensed water according to claim 1, further comprising at least one element selected from the group consisting of, by weight %, Si: 0.005 to 0.5%;

Al: 0.005 to 0.07%,

Cu: 0.05 to 1.0%;

Ni: 0.05 to 2.0%;

Mo: 0.05 to 1.0%;

Nb: 0.005 to 0.1%;

Ti: 0.005 to 0.1%;

B: 0.003 to 0.005%.

3. A steel plate having good corrosion resistance to condensed water consisting essentially of, by weight %, C: 0.05 or less;

Mn: 0.2 to 1.6%;

S: 0.01% or less;

P: 0.01% to 0.3%;

Cu: 0.05 to 2.5%;

Ni: 0.05 to 5.0%;

V: 0.005 to 0.1%;

Ca: 0.0005 to 0.01%;

and the remainder being Fe and unavoidable impurities.

4. The steel plate having good corrosion resistance to condensed water according to claim 3, further comprising at least one element selected from the group consisting of, by weight %, Mo: 0.05 to 1.0%;

Si: 0.005 to 0.5%;

Al: 0.005 to 0.07%;

Nb: 0.005 to 0.1%;

Ti: 0.005 to 0.1%;

B: 0.003 to 0.005%.

* * * * *